United States Patent [19]

Maitlen

[11] Patent Number: 4,819,346

[45] **Date of Patent: * Apr. 11, 1989**

[54] DREDGE CUTTING HEAD WITH SHOCK ABSORBER

[75] Inventor: C. Gene Maitlen, Oklahoma City, Okla.

[73] Assignee: VMI, Inc., Oklahoma City, Okla.

[ * ] Notice: The portion of the term of this patent subsequent to Aug. 23, 2005 has been disclaimed.

[21] Appl. No.: 152,309

[22] Filed: Feb. 4, 1988

Related U.S. Application Data

[63] Continuation of Ser. No. 843,655, Mar. 25, 1986, Pat. No. 4,765,071.

[51] Int. Cl.[4] ..... E02F 3/88

[52] U.S. Cl. ..... 37/66

[58] Field of Search ..... 37/58, 64–67, 37/189

[56] References Cited

U.S. PATENT DOCUMENTS

| | | | |
|---|---|---|---|
| 411,183 | 9/1889 | Bowers | 37/66 |
| 501,870 | 7/1893 | Collins | 37/66 X |
| 598,988 | 2/1898 | Heath | 37/66 |
| 1,701,430 | 2/1929 | Thurston | 37/66 |
| 2,366,624 | 12/1941 | Kelsey | 464/89 |
| 2,970,694 | 2/1961 | Klyce | 209/367 |
| 3,419,976 | 1/1969 | Reising | 37/94 |
| 4,095,545 | 6/1978 | Vaughn et al. | 114/26 |
| 4,385,893 | 5/1983 | Kirschey | 464/17 |
| 4,521,305 | 6/1985 | Deal | 210/158 |

*Primary Examiner*—Clifford D. Crowder

*Attorney, Agent, or Firm*—Laney, Dougherty, Hessin & Beavers

[57] ABSTRACT

An improved cutter head for a floating dredge of the type having a lowerable boom with cutter head on the lowerable end thereof. The cutter head includes a rotatable open axis cage of cutter bars mounted adjacent to and along a rectangular suction inlet so that material to be shredded and sludge material are drawn into and through the rotating cage for shredding. Teeth are mounted on the cage bars for digging and breaking dredge material encountered by the teeth. The cage is connected to a drive plate having shock absorbing grommets which absorb axial, tangential and radial shocks received by the rotating cage.

16 Claims, 3 Drawing Sheets

DREDGE CUTTING HEAD WITH SHOCK ABSORBER

This is a continuation of co-pending Application Ser. No. 843,655, filed on Mar. 25, 1986, now U.S. Pat. No. 4,765,071.

BACKGROUND OF THE INVENTION

1. Field of the Invention

This invention relates generally to devices for dredging, and more particularly, but not by way of limitation, to such devices having a lowerable boom with a rotor cutting head at the end thereof for cutting and moving vegetation and sludge material to a suction inlet of the dredge.

2. Description of the Prior Art

Dredging devices for dredging municipal sludge wastewater ponds, river beds, lake beds, sea floors and the like, have utilized lowerable booms with the lowerable end having various digging or dredging cutting heads on the end thereof. U.S. Pat. No. 4,095,545 shows a device having a cylindrical rotating dredge implement on the end of a lowerable boom. The cylinder dredge implement or rotor has teeth extending out from the cylinder and these teeth bite into vegetation and sludge as the cylinder rotates. The teeth carry the vegetation and sludge around the cylinder to a linear suction intake opening located behind the cylinder. The teeth move between a stationary cutter bar mounted adjacent to the suction intake so as to shred the material carried by the teeth. The rotor and boom are hydraulically operated.

Other dredging devices, such as those shown in U.S. Pats. Nos. 3,962,803; 3,738,029; and 3,521,387 have lowerable boom structures with spiral augers mounted horizontally on the ends of the booms. These augers rotate to dig and move material toward a suction intake. The augers are mounted on a solid bar adjacent the suction intake.

It is an object of the present invention to provide an improved rotor cutting head and suction implement for use on a lowerable boom on a dredge. More particularly it is an object to provide such a rotor which is more efficient in digging and dredging material that requires shredding such as fibrous municipal waste and vegetation.

Another object of the present invention is to provide an improved rotor which is better able to receive shocks thereto without damage.

SUMMARY OF THE INVENTION

In accordance with these objects the present invention provides an improved cutter head for a boat dredge of the type supporting a lowerable boom with a linear sludge intake, rotor and rotor drive on the lowerable end of the boom. The rotor comprises an open axis cylindrical cage of tooth-carrying bars for digging, shredding and conveying sludge materials to the linear sludge intake. Sludge material and fibrous material can pass into and through the cage bars enroute to the linear intake. For example, material can be drawn through the cage bars by the suction intake and the rotation of the cage shreds the material which passes through the bars. The rotor cage is disposed along and adjacent the linear intake so that material is drawn through the cage as it passes to the intake. The cage is connected for rotation to the rotor drive.

To protect the rotor against shock, a shock absorber is provided. The cage bars are connected for rotation to the rotor drive by a support ring rigidly connected to the cage bars. Resilient connectors extend between the support ring and the rotor drive to absorb shocks received by the cage bars. The resilient connectors comprise grommets mounted in a drive ring. The drive ring is connected to the support ring by means of bolts extending through the rubber grommets.

For a further understanding of the invention, and further objects, features and advantages thereof, reference may now be had to the following description taken in conjunction with the accompanying drawings.

DESCRIPTION OF PREFERRED EMBODIMENTS

Figure 1:
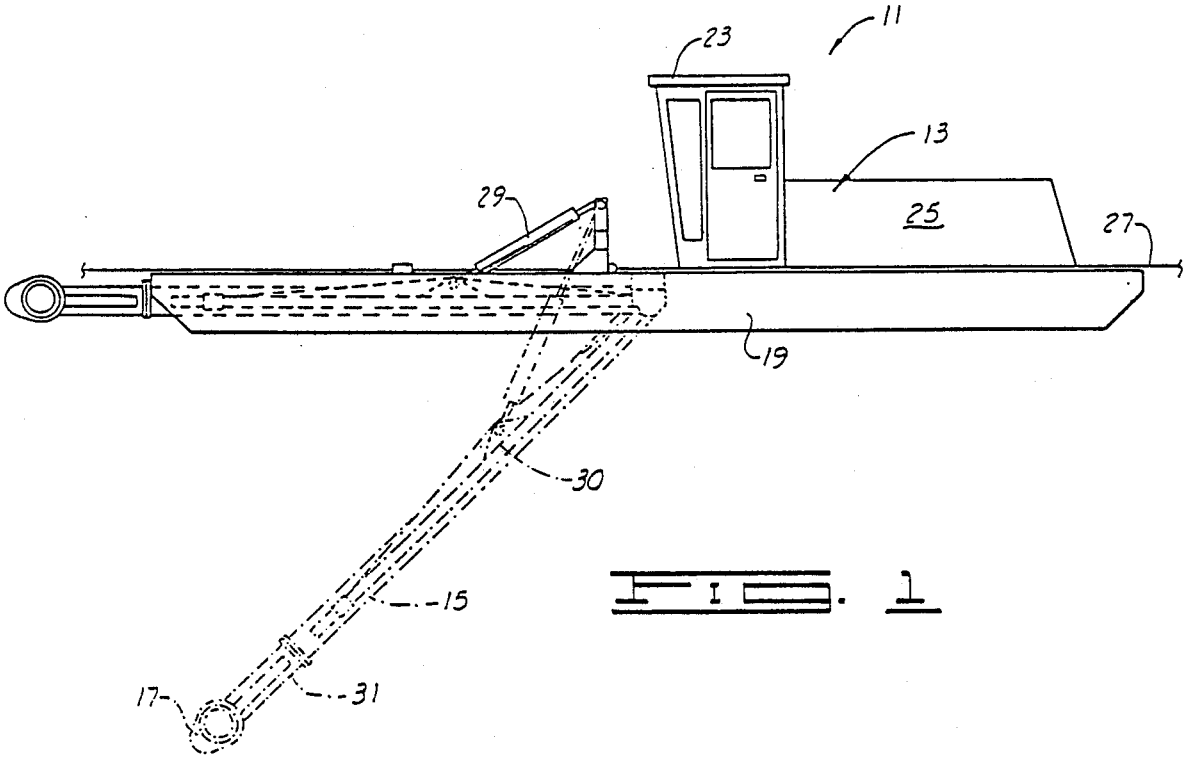
FIG. 1 is a side elevational view of the dredging device and rotor constructed in accordance with the present invention.
Figure 2:
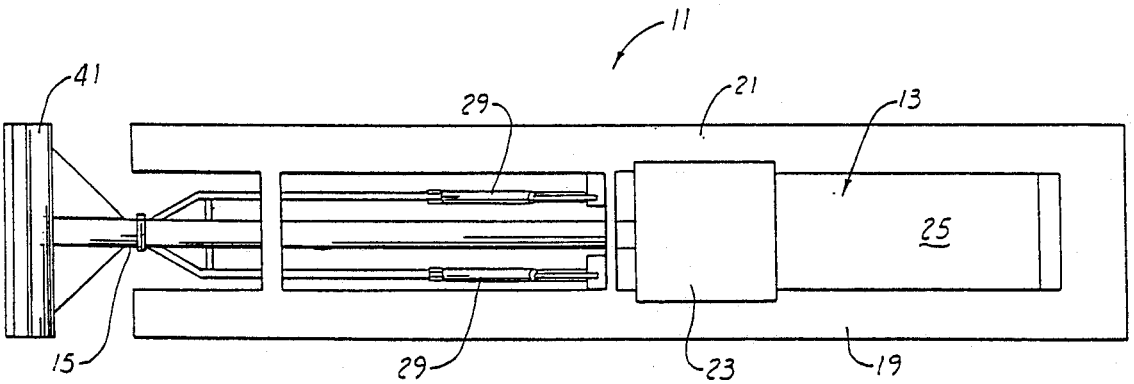
FIG. 2 is a plan view of the dredging device shown in FIG. 1.

Referring now to FIGS. 1 and 2, a dredging apparatus 11 is shown. The dredging apparatus 11 includes a boat 13 having a lowerable boom 15. A rotor 17 at the end of the boom 15 dredges vegetation and sludge material from the floor of bodies of water which material is carried through the suction conduit of the boom 15 to a desired location. A similar device is described in U.S. Pat. No. 4,095,545 and the description thereof is incorporated herein by reference.

The boat 13 includes a pair of parallel buoyant pontoons 19 and 21 upon which a pilot house 23 is mounted. An engine 25 is mounted behind the pilot house 23.

The boat 13 can be moved across bodies of water by means of a cable 27 connected to the shore or by a water jet propulsion. Such devices are conventional. This allows the boat 13 to move to a desired dredging location and then move in a controlled manner during the dredging operation itself.

The boom 15 is hydraulically raised and lowered by hydraulic pistons 29 connected to a frame 30 of the boom 15. The hydraulic pistons are controlled from the pilot house to move the boom between a raised, horizontal position between the pontoons 19 and 21 and a lowered, dredging position. The rotor 17 on the lowerable, distal end of the boom 15 can thus be lowered a desired amount to encounter the floor of a body of water to be dredged.

Figure 3:
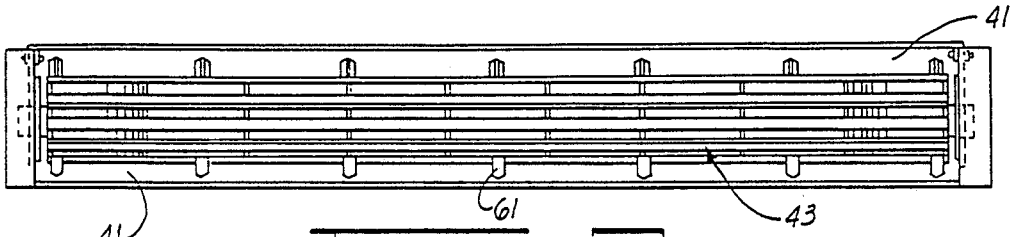
FIG. 3 is an enlarged front view of the lowerable end of the boom of the device shown in FIG. 1.
Figure 4:
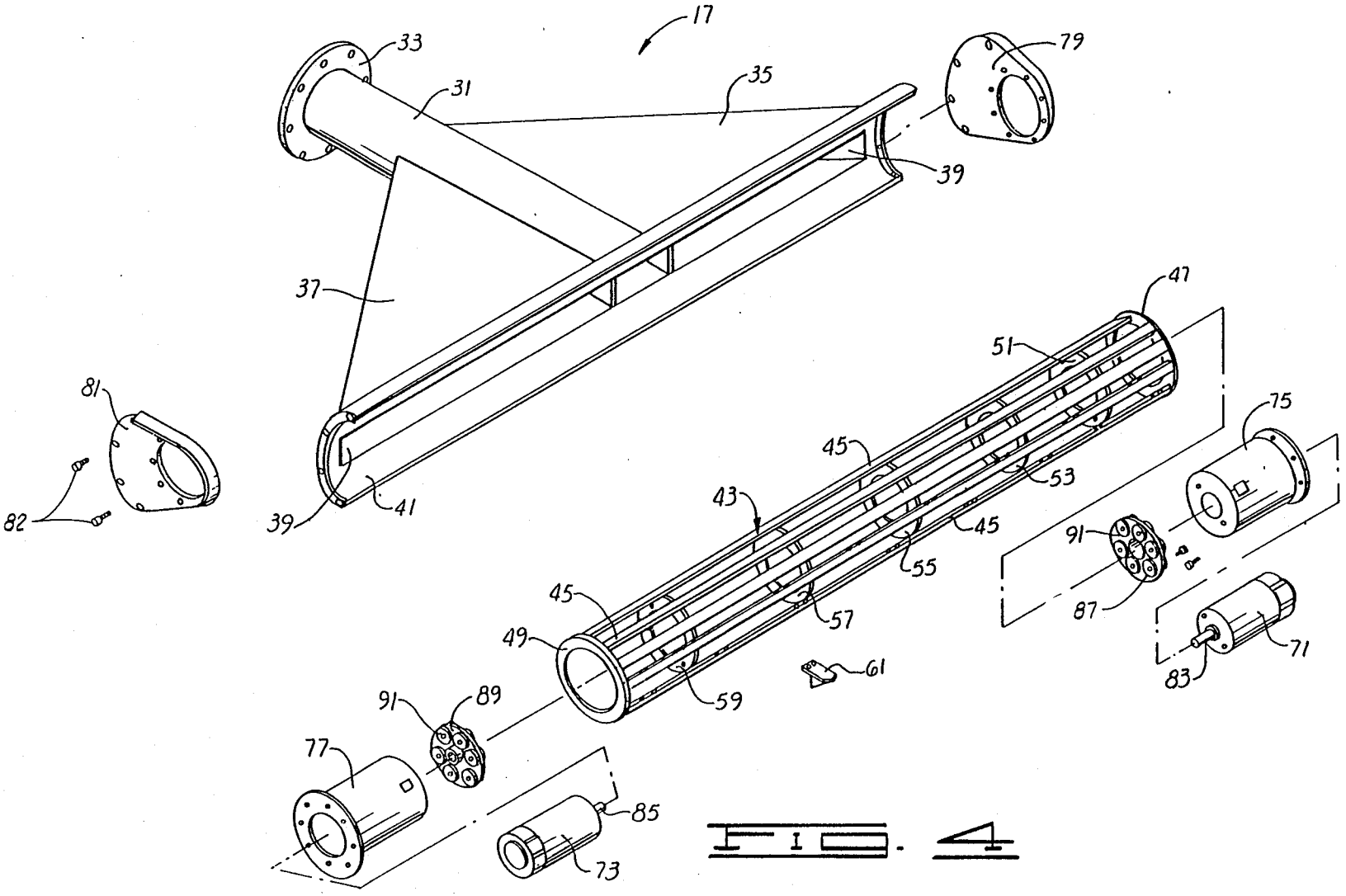
FIG. 4 is an exploded isometric view of the device shown in FIG. 3.

Referring now to FIGS. 3 and 4, the cutting head on the lowerable end 17 of the boom 15 is shown in more detail. It includes a main duct 31 connected to the end of the boom 15 by a flange 33. The main duct 31 is cylindrical and structurally supports the end of the boom 15. It widens with duct legs 35 and 37 to a rectangular suction inlet opening 39 which extends the full width of the end of the boom 15. The dimensions of the rectangular suction inlet 39 are approximately 3 inches by 8 feet.

An arcuately shaped plate 41 welded to the main duct 31 and duct legs 35 and 37 frames the suction inlet opening 39 and directs material into the opening 39.

Mounted for rotation adjacent to the full width suction inlet 39 and plate 41 is an open axis cylindrical cage 43. The open axis cage 43 is comprised of tooth-carrying bars 45 disposed horizontally and parallel to each other in a cylindrical relationship. The bars 45 are each welded to end support rings 47 and 49 and interior support rings 51 through 59. The bars 45 are uniformly spaced about the rings 51 through 59.

The cage 43 has a diameter of approximately 8 inches and each of the bars 45 has a tangential width of approximately 2 inches and a radial depth of approximately three-quarters of an inch. The bars are spaced approximately 2 inches apart. The cage is approximately 8 feet long and the rings 47 through 59 are spaced at approximately one and one-half foot intervals along the axis of the cage.

Each of the bars 45 carries teeth 61 at approximately one and one-half foot intervals (the teeth are only shown on two of the bars in FIG. 3 and are not shown attached to the bars in FIG. 4 for clarity of detail in the drawing). The teeth are staggered on adjacent bars so that the path traveled by the teeth on a first bar is not repeated in the following bar. The cage rotates so that the teeth at the bottom of the cage move forward (away from the suction inlet 39) and the teeth at the top of the cage move backward (toward the suction inlet 39). If desired for cleaning or other reasons the rotation of the cage can be reversed.

Figure 6:
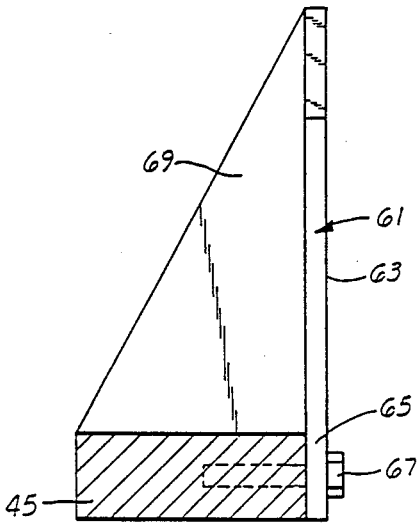
FIG. 6 is a side cross-sectional view of a bar and tooth shown in FIG. 4.
Figure 7:
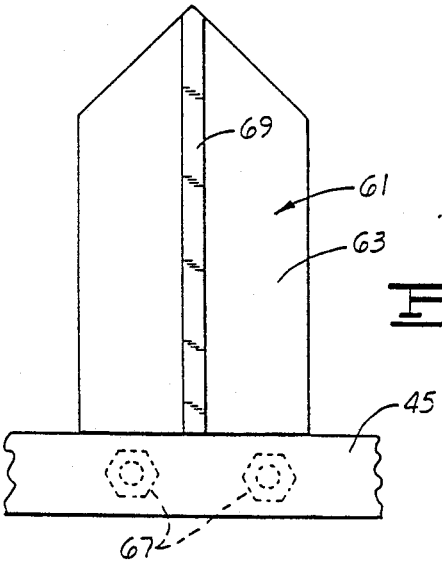
FIG. 7 is a rear view of the device shown in FIG. 6.

A tooth 61 is shown in more detail in FIGS. 6 and 7. The tooth 61 includes a rectangular, pointed cutting plate 63 attached at its shank 65 to the bar 45. Two bolts 67 extend through the shank 65 into the bar 45. A triangular support web 69 extends normally to the cutting plate 63 from the point of the cutting plate 63 to the shank 65 and rests on the radially outer surface of the bar 45 to support the tooth 61 as it cuts through sludge material or the like.

The cage 43 is rotated by hydraulic motors 71 and 73. The motors 71 and 73 are mounted inside motor drums 75 and 77, respectively. The motor drums, in turn, are bolted to end plates 79 and 81 which are bolted by bolts such as bolts 82 to the ends of the arcuately-shaped plate 41. Thus, the plate 41 rigidly holds the motors 71 and 73 which rotate the cage 43.

The motors 71 and 73 have splined shafts 83 and 85 which mate with splined drive hubs 87 and 89, respectively. The splined drive hubs 87 and 89 are round plates with shock absorbing rubber grommets 91 extending through the periphery thereof. Bolts such as bolt 92 extend through these grommets to the interior support rings 51 and 59, respectively. The rotation of the splined motor shafts 83 and 85, is thus transmitted to rotate the cage 43 through the splined drive hubs 87.

Figure 5:
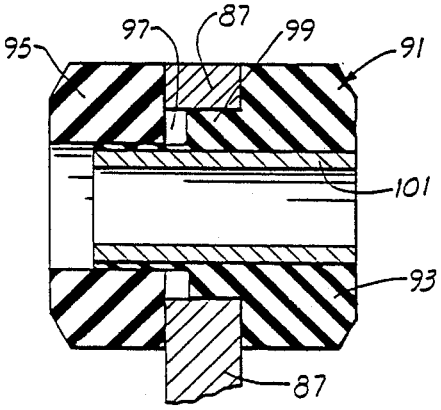
FIG. 5 is an enlarged side cross-sectional view of a portion of the drive plate shown in FIG. 4.

A grommet 91 is shown in more detail in FIG. 5 which depicts a cross-sectional view through the center of a grommet 91 mounted in a drive hub 87. The grommet 91 includes a male grommet half 93 and a female grommet half 95. These two halves mate together through a cylindrical opening 97 in the periphery of the splined drive hub 87. They mate in such a manner that a rubber cushion 99 is created inside the opening 97. The rubber cushion 99 extends around the bolt which holds the splined hub 87 to the interior support ring of the cage 43. The male and female halves 93 and 95, respectively, extend outwardly from the sides of the splined drive hubs 87. Thus, the outside portions of the grommet 91 can absorb axial shocks to the cage 43 while the interior cushion 99 can absorb radial and tangential shocks to the cage 43.

A metal bushing 101 extends through and is molded to the interior of the male half 93 of the grommet 91. When the halves 93 and 95 are mated together the metal bushing 101 extends through the interior of the female half 95 so as to protect the interior of both halves 93 and 95 with respect to a bolt extending through the bushing and holding the splined drive hub 87 to the interior support ring of the cage 43.

In operation, hydraulic motors 71 and 73 rotate the cage 43 in the range from 20 to approximately 150 revolutions per minute. This allows the material to move into the cage 43 and be shredded by the bars 45. The teeth 61 move into sludge encountered in the dredging operation and dig and cut the sludge material before being moved to the suction intake 39. Material to be shredded and sludge material can move into and through the cage 43 as it passes to the suction intake 39. This advantageously allows material to move more efficiently to the suction intake while being shredded and broken into sizes satisfactory for entering the suction intake 39.

Since rocks, logs and other material are occasionally encountered during dredging, the shock absorbing grommets 91 importantly protect the cage 43 and the motors 71 and 73 with respect to shocks created by such obstacles.

As can be seen, the cutting head of the present invention is especially well adapted for cutting and shredding as well as digging and moving rocks and sludge. The open cage allows material to be pulled into and cut by the cage bars since the suction intake is located behind the cage and draws material to be shredded between the rotating cage bars. The teeth dig and move sludge and rocks toward the suction intake as well. The open cage allows the material not requiring shredding, such as sludge and rocks, to move to the suction intake in a more direct path. The shock absorbing drive plate prevents damage to the cage bars and motors as the cage rotates.

Thus, the dredge and rotor of the present invention is well adapted to obtain the objects and advantages mentioned as well as those inherent therein. While presently preferred embodiments of the invention have been described for the purpose of this disclosure, numerous changes in the construction and arrangement of the parts can be made by those skilled in the art, which changes are encompassed within the spirit of this invention as defined by the appended claims.

The foregoing disclosure in the showings made in the drawings are merely illustrative to the principles of this invention and are not to be interpreted in a limiting sense.

What is claimed is:

1. An improved dredge device of the type having a boat supporting a lowerable boom with a linear suction intake, rotor and rotor drive on the lowerable end thereof for dredging material on the floor of bodies of water, the improvement comprising:

said rotor comprising a cylindrical cage of cutter bars, said bars having a plurality of teeth extending therefrom, for digging, shredding and conveying sludge material to the linear suction intake and into which cage and through which cage vegetation and sludge material can pass in route to said linear intake, said linear intake being disposed along and adjacent said rotor so as to draw sludge material through said cage, said cylindrical cage being connected for rotation to said rotor drive by a support ring rigidly connected to said cutter bars; and shock absorbing means connected between said support ring and said rotor drive for absorbing axial, radial and tangential shocks received by said cage of cutter bars.

2. The device of claim 1 wherein said shock absorbing means comprise at least one resilient connector.

3. The device of claim 1 wherein said cutter bars are disposed parallel to each other in a cylindrical relationship.

4. The device of claim 1 wherein said teeth extending from said bars are disposed on adjacent bars whereby the path traveled by said teeth on a first bar is not repeated by the teeth on a bar adjacent to said first bar.

5. The device of claim 1 wherein said cage of cutter bars is rotatable in both a clockwise and counterclockwise direction.

6. The device of claim 1 wherein each of said teeth comprises:

a cutting plate attached to said bar from which said tooth extends; and support means attached to said cutting plate and to said bar for supporting said tooth.

7. A cutter head for a floating dredge, comprising:

a lowerable boom having a horizontal, linear suction inlet on the lowerable end thereof;

a horizontal, cylindrical cage of cutter bars mounted for rotation adjacent to said suction inlet so that cutter bars, said cutter bars having a plurality of teeth extending therefrom for digging dredge material encountered by said teeth;

rotor drive means connected to said boom for rotating said cage, said cage of cutter bars being connected to said rotor drive means by a support ring rigidly connected to said cutter bars;

and shock absorbing means connected between said support ring and said rotor drive means for absorbing axial, radial and tangential shocks received by said cage of cutter bars.

8. The cutter head of claim 7 wherein said shock absorbing means comprise at least one resilient connector.

9. The cutter head of claim 8 wherein said cutter bars are disposed parallel to each other in a cylindrical relationship.

10. The cutter head of claim 8 wherein said teeth extending from said bars are staggered on adjacent bars whereby the path traveled by said teeth on a first bar is not repeated by the teeth on a bar adjacent to said first bar.

11. The cutter head of claim 8 wherein said cage of cutter bars is rotatable in both a clockwise and counterclockwise direction.

12. The cutter head of claim 8 wherein each of said teeth comprise:

a cutting plate attached to said bar from which said tooth extends; and support means attached to said cutting plate and to said bar for supporting said tooth.

13. A cutter head for a floating dredge, comprising:

a lowerable boom having a horizontal linear suction inlet on the lowerable end thereof;

a horizontal, cylindrical cage of cutter bars disposed parallel to each other in a cylindrical relationship and mounted for rotation adjacent to said linear suction inlet so that material is drawn into and through said cage of cutter bars, said cutter bars having a plurality of teeth extending therefrom for digging dredge material encountered by said teeth;

rotor drive means connected to said boom for rotating said cage for shredding material passing through said cage, said cage of cutter bars being connected to said rotor drive means by a support ring rigidly connected to said cutter bars; and shock absorbing means comprising at least one resilient connector connected between said support ring and said rotor drive means for absorbing axial, radial and tangential shocks received by said cage of cutter bars.

14. The cutter head of claim 13 wherein said teeth extending from said bars are staggered on adjacent bars whereby the path traveled by said teeth on a first bar is not repeated by the teeth on a bar adjacent to said first bar.

15. The cutter head of claim 14 wherein said cage of cutter bars is rotatable in both a clockwise and counterclockwise direction.

16. The cutter head of claim 15 wherein each of said teeth comprises:

a rectangular cutting plate attached to said bar from which said tooth extends; and a triangular support member attached to said cutting plate and to said bar for supporting said tooth.

* * * * *

UNITED STATES PATENT AND TRADEMARK OFFICE

CERTIFICATE OF CORRECTION

PATENT NO. : 4,819,346

DATED : April 11, 1989

INVENTOR(S) : C. Gene Maitlen

It is certified that error appears in the above-identified patent and that said Letters Patent is hereby corrected as shown below:

Column 5, lines 36 and 37, insert the phrase --material is drawn into and through said cage of-- between the word "that" and the word "cutter";

Column 5, line 41, insert the phrase --for shredding material passing through said cage-- between "cage" (first use of the word "cage") and the comma;

Column 5, line 44, insert the word --and-- after the semicolon; and

Column 5, line 45, delete the word "and".

Signed and Sealed this

Twenty-first Day of November, 1989

*Attest:*

JEFFREY M. SAMUELS

*Attesting Officer* *Acting Commissioner of Patents and Trademarks*